US008785756B2

(12) United States Patent
Murozono

(10) Patent No.: US 8,785,756 B2
(45) Date of Patent: Jul. 22, 2014

(54) ANGLE ADJUSTER FOR MUSIC STAND AND KEYBOARD INSTRUMENT WITH ANGLE ADJUSTER

(71) Applicant: Kabushiki Kaisha Gakki Seisakusho, Hamamatsu (JP)

(72) Inventor: Naotaka Murozono, Hamamatsu (JP)

(73) Assignee: Kabushiki Kaisha Kawai Gakki Seisakusho (JP)

( * ) Notice: Subject to any disclaimer, the term of this patent is extended or adjusted under 35 U.S.C. 154(b) by 0 days.

(21) Appl. No.: 13/905,319

(22) Filed: May 30, 2013

(65) Prior Publication Data

US 2013/0319204 A1 Dec. 5, 2013

(30) Foreign Application Priority Data

May 31, 2012 (JP) ..... 2012-124531

(51) Int. Cl.
*G10D 9/00* (2006.01)

(52) U.S. Cl.
USPC ..... 84/453

(58) Field of Classification Search
USPC ..... 84/453, 327, 329, 421; 248/443
See application file for complete search history.

(56) References Cited

U.S. PATENT DOCUMENTS 6,050,536 A * 4/2000 Bicknese ..... 248/441.1

FOREIGN PATENT DOCUMENTS

| | | | | |
|---|---|---|---|---|
| JP | 07230270 A | * | 8/1995 | ..... 84/253 |
| JP | 2900298 | | 6/1999 | |
| JP | 11352955 A | * | 12/1999 | ..... 84/253 |
| JP | 2000181443 | | 6/2000 | |
| JP | 2002258833 | | 9/2002 | |
| JP | 3565728 | | 9/2004 | |
| JP | 4037322 | | 1/2008 | |

OTHER PUBLICATIONS

Kawai General Catalogue of Educational Musical Instruments and Devices, Mar. 2012, 6 pages. English language summary provided.

* cited by examiner

*Primary Examiner* — Kimberly Lockett
(74) *Attorney, Agent, or Firm* — Grossman Tucker Perreault & Pfleger PLLC

(57) ABSTRACT

An angle adjuster for a music stand includes: a pair of thick portions having a thickness equivalent to a thickness of a two-fold hinge in a folded state and arranged to be mutually parallel; and an intermediate portion arranged between the pair of thick portions and recessed relative to upper surfaces of the thick portions perpendicular to a thickness direction thereof. The intermediate portion includes a plurality of catching portions provided mutually parallely along a longitudinal direction of the thick portions, each of the catching portions being configured to catch one end of a support bar to support the music stand.

7 Claims, 6 Drawing Sheets

ANGLE ADJUSTER FOR MUSIC STAND AND KEYBOARD INSTRUMENT WITH ANGLE ADJUSTER

CROSS-REFERENCE TO RELATED APPLICATIONS

This application claims the benefit of Japanese Patent Application No. 2012-124531, filed May 31, 2012, in the Japan Patent Office, the entirety of which is incorporated herein by reference.

BACKGROUND

The present invention relates to an angle adjuster for a music stand and a keyboard instrument with the angle adjuster.

In manufacturing of keyboard instruments, it has today become a big issue in product development how many functions can be provided in a keyboard instrument while reducing manufacturing costs.

In a conventional keyboard instrument 100, including a structure to raise a music stand 190 laid down on a top plate 192 toward a player side and to set up the music stand 190 on the top plate 192 as shown in FIG. 4, there is used a special hinge 199 having two joints as shown in FIG. 5A (see, for example, Trade Name: CA93, page 45 of Kawai General Catalogue of Educational Musical Instruments and Devices (issued March, 2012)).

The hinge 199 includes a first portion 199*a* configured to be attached to the top plate 192, a second portion 199*b* pivotably attached to the first portion 199*a* and configured to be attached to the music stand 190, and a third portion 199*c* pivotably attached to the second portion 199*b*.

The first portion 199*a* is provided, at a free end thereof, with a projection 199*d* to catch a free end of the third portion 199*c*.

Also, in the hinge 199, the second portion 199*b* is configured to have a length such that, when the music stand 190 is folded, a joint 199*e* between the second portion 199*b* and the third portion 199*c* is located on an inner side of the projection 199*d* of the first portion 199*a*, as shown in FIG. 6. This is because if the joint 199*e* is located on an outer side of the projection 199*d* of the first portion 199*a* when the music stand 190 is folded, the joint 199*e* may hit and damage the top plate 192.

In a case of raising the music stand 190 toward the player side and setting up the music stand 190 on the top plate 192 by means of the hinge 199, the free end of the third portion 199*c* is made to be caught by the projection 199*d* provided at the free end of the first portion 199*a*, so that the first portion 199*a*, the second portion 199*b*, and the third portion 199*c* are secured in a triangular arrangement as shown in FIG. 5B.

SUMMARY

There involves a problem that the aforementioned hinge 199 has a complex configuration, such as having two joints, and also at least two such special hinges 199 are required when assembling a keyboard instrument, which results in an increased manufacturing cost.

In addition, it is impossible to adjust an angle of the music stand 190 with the hinge 199. Even worse, if any load is applied to the music stand 190 from above while the music stand 190 is folded, the hinge 199 may be broken.

Therefore, it is desired that the present invention provide an angle adjuster that may suppress a manufacturing cost of a keyboard instrument, suppress breakage of a hinge, and achieve an increased functionality of the keyboard instrument, and also provide a keyboard instrument with the angle adjuster.

Hereinafter, descriptions will be given of configurations of an angle adjuster for a music stand and a keyboard instrument according to the present invention.

The angle adjuster for a music stand of the present invention includes: a pair of thick portions having a thickness equivalent to a thickness of a two-fold hinge in a folded state and arranged to be mutually parallel; and an intermediate portion arranged between the pair of thick portions and recessed relative to upper surfaces of the thick portions perpendicular to a thickness direction thereof. The intermediate portion includes a plurality of catching portions provided mutually parallel along a longitudinal direction of the thick portions, each of the catching portions being configured to catch one end of a support bar to support the music stand.

In a case of assembling a keyboard instrument using the angle adjuster of the present invention, it may be configured, for example, such that the angle adjuster is attached to a top plate as a stand base for a music stand, the music stand is attached to the top plate with a two-fold hinge in a foldable manner relative to the top plate, and when setting up the music stand, one end of the support bar is caught by one of the catching portions of the angle adjuster, while the other end of the support bar supports the music stand.

In the case of manufacturing the keyboard instrument using the angle adjuster of the present invention, the thick portions have approximately the same thickness as the thickness of the two-fold hinge in a folded state. Accordingly, even if any load is applied to the music stand, the thick portions support the music stand and thus can suppress breakage of the hinge.

Also, in the case of manufacturing the keyboard instrument using the angle adjuster of the present invention, the angle adjuster of the present invention is manufactured as a special member. The angle adjuster of the present invention may be easily manufactured by means of extrusion molding, and its manufacturing cost is extremely low as compared with a manufacturing cost of the aforementioned special hinge having two joints. Accordingly, in the case of assembling the keyboard instrument using the angle adjuster of the present invention, the hinge may be a common two-fold hinge and the support bar may be a simple bar-like member. Thus, in the case of manufacturing the keyboard instrument using the angle adjuster of the present invention, the manufacturing cost can be extremely lowered as compared with the case of using the aforementioned special hinge.

Further, in the case of manufacturing the keyboard instrument using the angle adjuster of the present invention, angle adjustment of the music stand can be achieved while lowering the manufacturing cost as compared with a case of a conventional keyboard instrument, leading to an improved functionality of the keyboard instrument.

Here, it is needless to say that the music stand may be set up at a place other than the top plate.

In the present invention, the depth of the recessed intermediate portion of the angle adjuster may be equal to or greater than a thickness of the support bar. In this case, for example, by pivotably attaching the support bar to a reverse surface of the music stand (i.e., a surface opposite to a player side) such that the support bar is arranged to be received in the intermediate portion when the music stand is folded toward the stand base, it is possible to suppress the support bar from being caught between the music stand and the thick portions and thereby broken.

In the present invention, the intermediate portion of the angle adjuster may be configured to define a plurality of continuous wave shapes to form the plurality of catching portions. However, such configuration is not essential.

In the present invention, the intermediate portion of the angle adjuster may include a guide portion that is provided at one end side of the intermediate portion along a longitudinal direction of the thick portion and adjacent to a catching portion forming area, where the plurality of catching portions are provided, to guide the one end of the support bar to the catching portion forming area.

Since the angle adjuster is disposed at a place hidden by the music stand from the player side, it is difficult to make the one end of the support bar to be caught by one of the catching portions to thereby set up the music stand.

Here, the present invention may be configured such that the aforementioned guide portion is provided and, to set up the music stand, by simply placing the one end of the support bar on the guide portion and then moving the music stand, the support bar is guided by the guide portion to be automatically caught by the catching portion.

With such configuration, an operation to set up the music stand by making the music stand to be caught by the catching portion can be extremely easily performed.

In the angle adjuster of the present invention, when the intermediate portion includes a protruding portion that protrudes from a lower end of the thick portions in the thickness direction thereof, the protruding portion may have a positioning portion. When the protruding portion is fitted in an insertion hole provided in the stand base to which the angle adjuster is attached, the positioning portion abuts a wall surface of the insertion hole and defines a position of the protruding portion in the insertion hole.

With such configuration, when the protruding portion is fitted in the insertion hole provided in the stand base, a position of the angle adjuster relative to the stand base is secured, so that the angle adjuster can be arranged on the stand base in an accurate manner.

In the angle adjuster of the present invention, a peripheral area of each of the upper surfaces of the thick portions may be chamfered into a curved surface shape. With such configuration, it is possible to suppress as much as possible the risk that something is caught by the thick portion and thereby the angle adjuster is removed from the stand base.

The keyboard instrument according to the present invention is attached with the angle adjuster having one of the configurations as described above. The keyboard instrument includes the music stand; a stand base relative to which the music stand is folded; and the support bar to support the music stand. The angle adjuster is attached to the stand base, the music stand is configured to be foldable with the hinge relative to the stand base. The support bar is configured to support the music stand by the one end of the support bar being caught by one of the catching portions, and is attached to one surface of the music stand reverse to a surface thereof facing a player in a foldable manner relative to the music stand.

By including the aforementioned angle adjuster of the present invention, the keyboard instrument of the present invention can achieve a reduced manufacturing cost as compared with a case of using a special hinge as mentioned in the background description provided herein, and suppress breakage of the hinge. Further, the keyboard instrument of the present invention can achieve an improved functionality in that angle adjustment of the music stand is available.

BRIEF DESCRIPTION OF THE DRAWINGS

The invention will now be described below, by way of example, with reference to the accompanying drawings, in which.

DETAILED DESCRIPTION OF THE PREFERRED EMBODIMENTS

In one embodiment described below, a player side is referred to as front, a right side viewed from a player is referred to as right, and a left side viewed from the player is referred to as left.

Figure 1B:
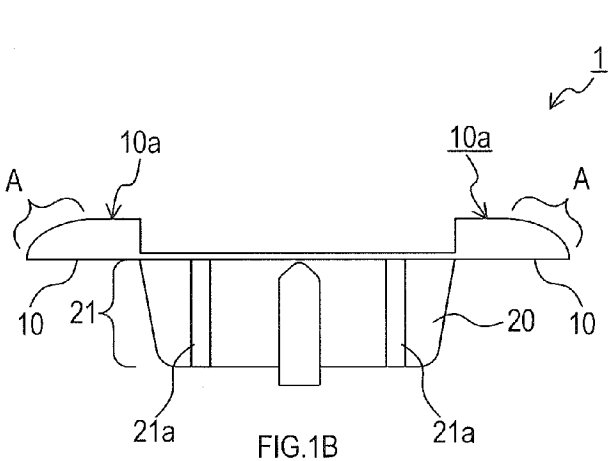
FIG. 1B is a rear view illustrating the angle adjuster of the present embodiment.
Figure 1A:
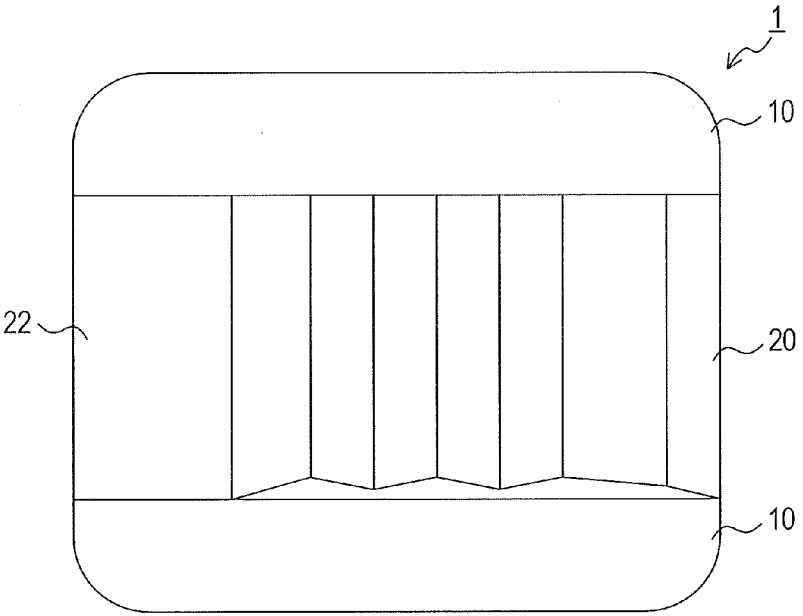
FIG. 1A is a plan view illustrating an angle adjuster according to one embodiment of the present invention.

An angle adjuster 1 of the present embodiment is a member for angle adjustment of a music stand of an electronic piano, and mainly includes a pair of thick portions 10 and an intermediate portion 20, as shown in FIGS. 1A and 1B. The thick portions 10, each of which is configured to have a thickness equal to or more than a thickness of a later-described typical two-fold hinge in a folded state, are arranged in parallel with a predetermined distance therebetween.

A peripheral area of an upper surface 10*a* (an area indicated by A in FIG. 1B) of the thick portion 10 is chamfered into a curved surface shape. Here, the upper surface 10*a* of the thick portion 10 means a surface located on an upper side in a normal state where the angle adjuster 1 is attached to the electronic piano and used.

Figure 2:
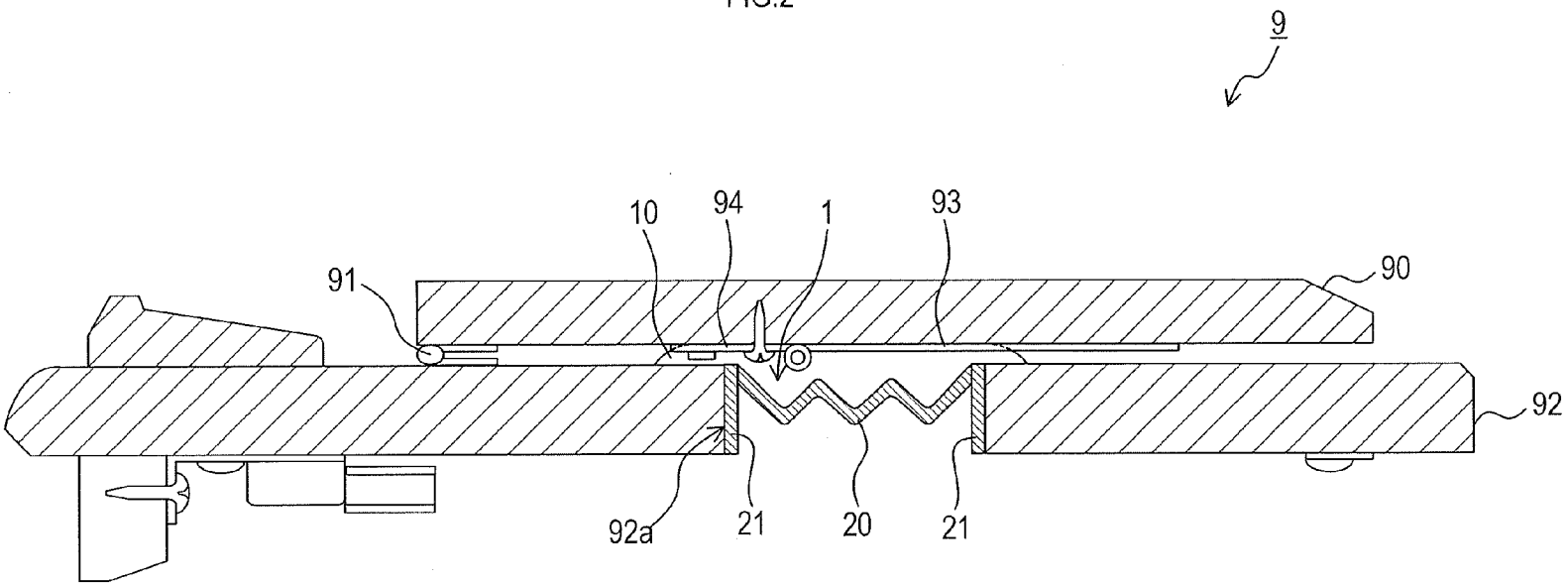
FIG. 2 is a cross-sectional view showing a state of a music stand of an electronic piano attached with the angle adjuster of the present embodiment folded relative to a top plate, in a cross-section along a front-to-rear direction passing a center of a right-to-left width direction of the angle adjuster.

The intermediate portion 20 is arranged between the thick portions 10, and is formed into a recess relative to the upper surfaces 10*a* perpendicular to a thickness direction of the thick portions 10, as shown in FIG. 1B. As shown in FIG. 2, the recess is configured to have a depth equal to or more than a thickness of a later-described support bar 93, so that the support bar 93 is located in the recess when the support bar 93 is folded relative to a music stand 90, and then the music stand 90 is folded relative to a top plate 92.

As shown in FIG. 1A, since the intermediate portion 20 includes a plurality of catching portions 20*a* along a longitudinal direction of the thick portions 10. The intermediate portion 20 is configured to define a plurality of continuous wave shapes to form the plurality of catching portions 20*a*.

Figure 1C:
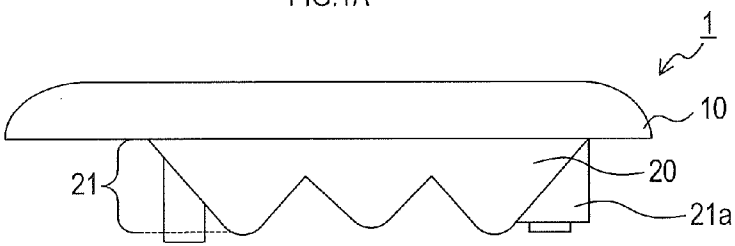
FIG. 1C is a side elevational view illustrating the angle adjuster of the present embodiment.

As shown in FIG. 1C, the intermediate portion 20 includes a protruding portion 21 that protrudes from a lower end of the thick portions 10 in the thickness direction thereof to form the catching portions 20*a*. Here, the lower end of the thick portions 10 in the thickness direction thereof means an end located on a lower side in the normal state where the angle adjuster 1 is attached to the electronic piano and used.

At a rear end of the protruding portion 21, there is provided a positioning member 21*a* to position the protruding portion 21 in a later-described insertion hole 92*a*. When the protruding portion 21 is inserted into the insertion hole 92*a* provided in the top plate 92 (see FIG. 2), the positioning member 21*a* abuts a wall surface of the insertion hole 92*a* and positions the protruding portion 21 in the insertion hole 92*a*.

In the intermediate portion 20, as shown in FIG. 1A, on the player side (at one end side along the longitudinal direction of the thick portions 10) of an area where the plurality of catching portions 20*a* are provided (corresponding to a catching portion forming area of the present invention), there is provided a guide portion 22 to guide the support bar 93 to the catching portions 20*a*.

Next, a description will be provided of an electronic piano 9 assembled using the aforementioned angle adjuster 1.

In a case of assembling the electronic piano 9 using the angle adjuster 1, the insertion hole 92*a* (see FIG. 2) is first formed at a place at which the angle adjuster 1 is to be attached in the top plate 92 to be provided with the music stand 90.

Then, the angle adjuster 1 is attached to the top plate 92 such that the protruding portion 21 of the angle adjuster 1 is inserted into the insertion hole 92*a*. A paste material for adhesion is injected into the insertion hole 92*a* in a state where the angle adjuster 1 is attached to the top plate 92, to thereby secure the angle adjuster 1 to the top plate 92.

When inserting the protruding portion 21 into the insertion hole 92*a*, the positioning member 21*a* is caused to abut a rear wall surface of the insertion hole 92*a* to accurately position the angle adjuster 1 relative to the insertion hole 92*a*. As a result, the angle adjuster 1 can be attached accurately at a predetermined position of the top plate 92.

The music stand 90 is attached to the top plate 92 in a foldable manner relative to the top plate 92 by means of two widely available two-fold hinges 91. The support bar 93 is designed to support the music stand 90 with one end thereof being caught by one of the catching portions 20*a* of the angle adjuster 1. The other end of the support bar 93 is attached to a surface of the music stand 90 reverse to a surface thereof facing a player in a foldable manner relative to the music stand 90 by means of a hinge 94.

Figure 3:
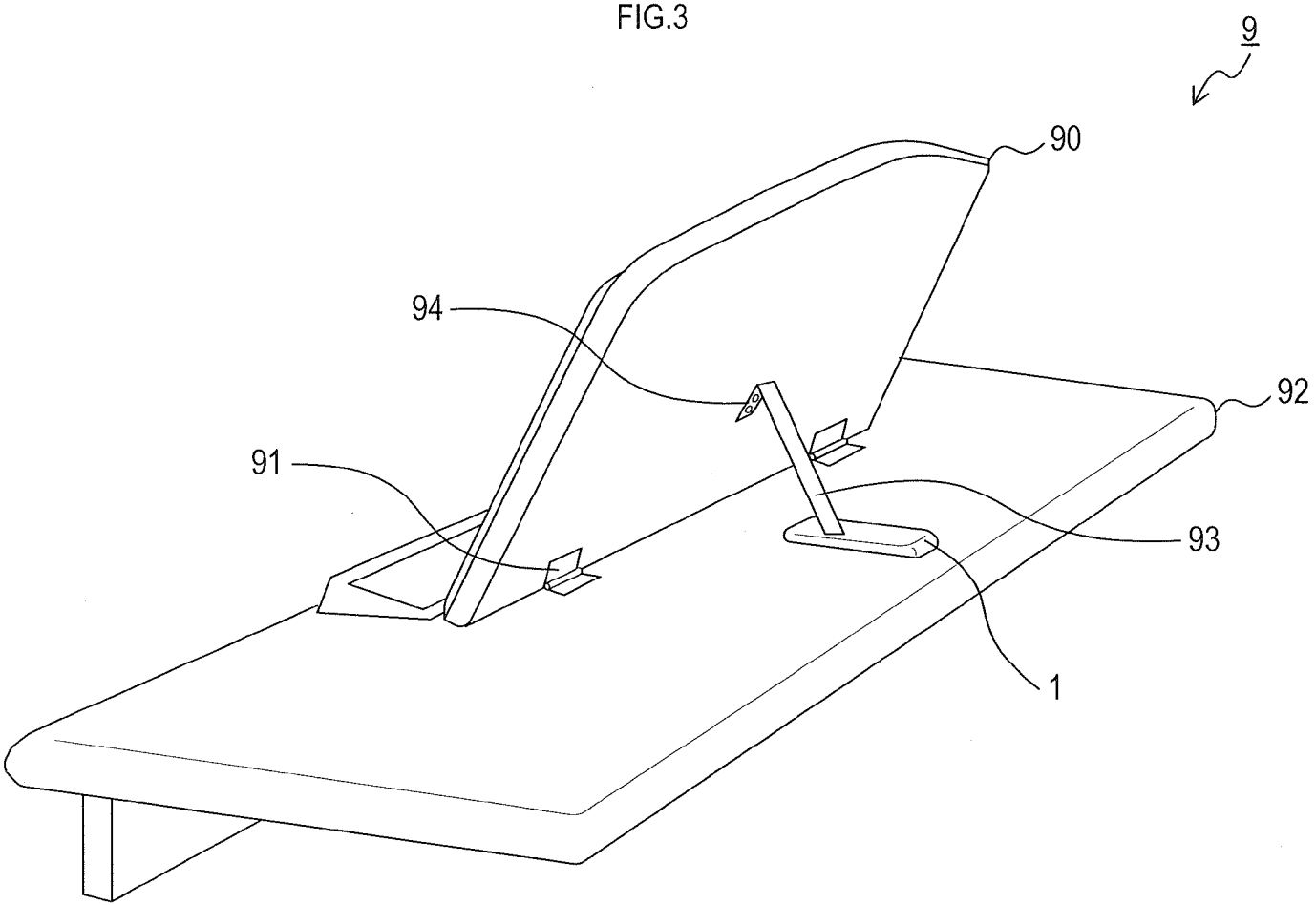
FIG. 3 is a perspective view of the top plate and the music stand of the electronic piano attached with the angle adjuster of the present embodiment.
Figure 4:
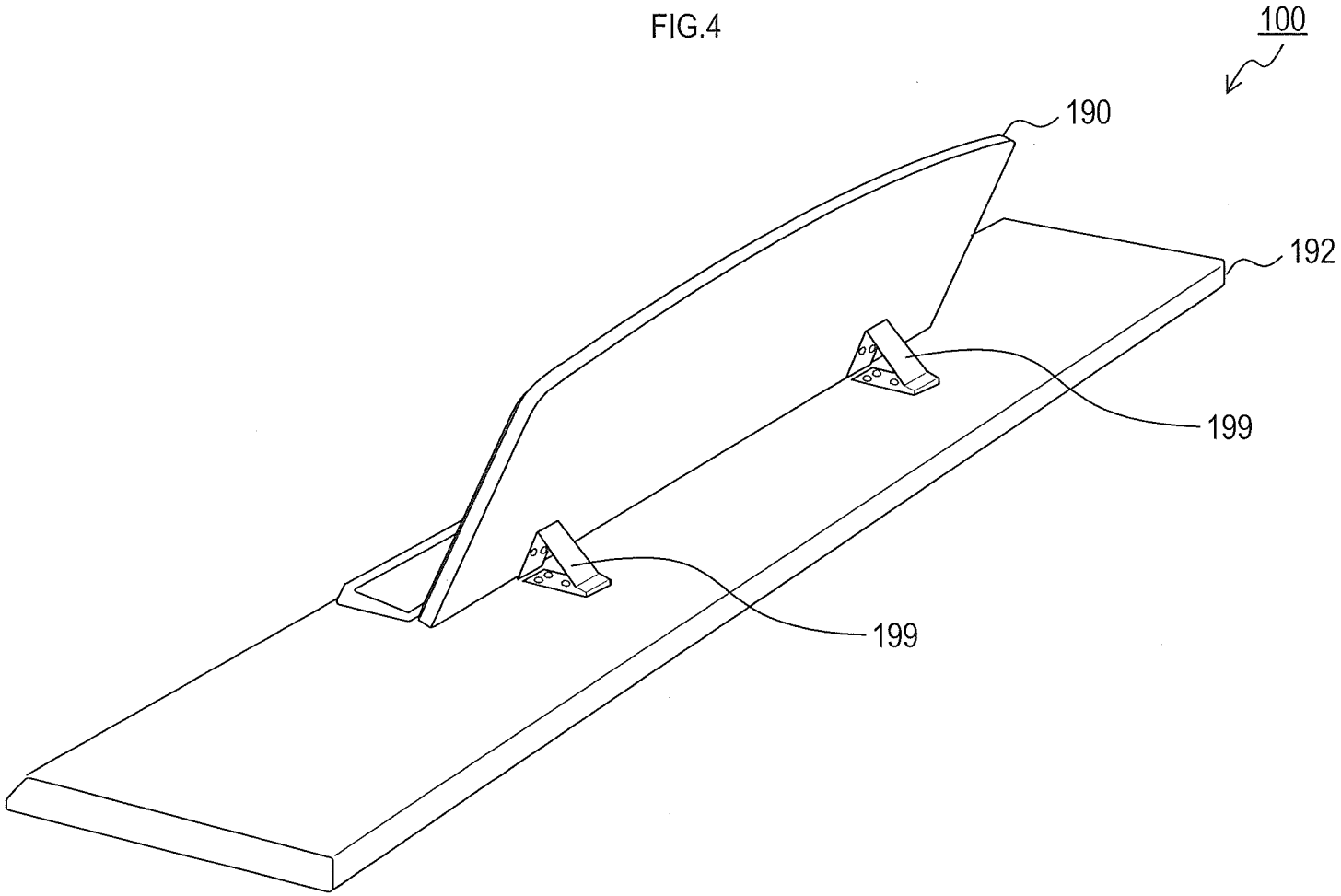
FIG. 4 is a view showing a state where a music stand is attached to a top plate using conventional hinges.
Figure 5B:
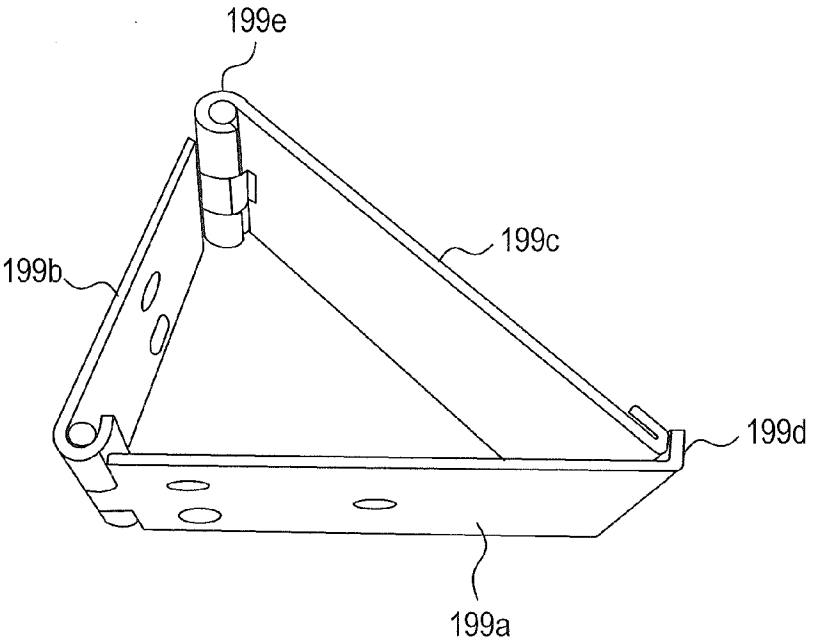
FIG. 5B is a perspective view of the hinge used in the conventional keyboard instrument, showing a state after the third member is caught by the first member.
Figure 5A:
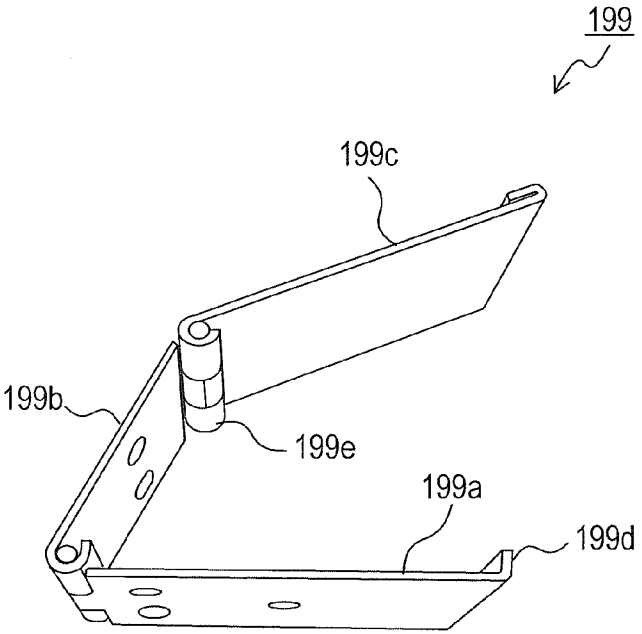
FIG. 5A is a perspective view of the hinge used in a conventional keyboard instrument, showing a state before a third member is caught by a first member.
Figure 6:
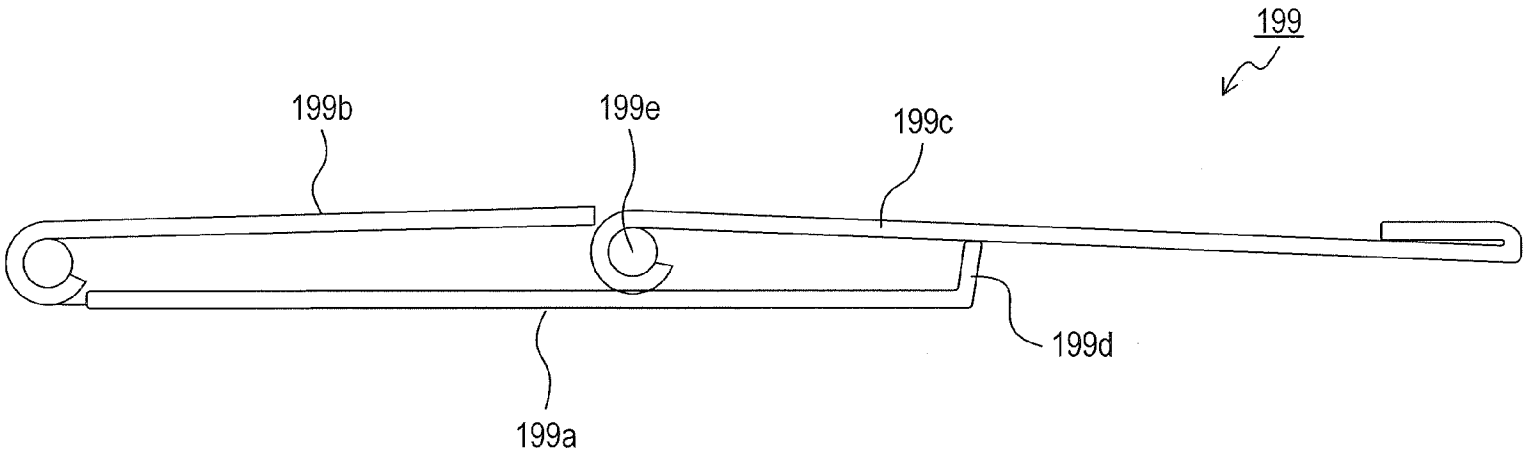
FIG. 6 is a side elevational view of the conventional hinge showing a folded state of the hinge.

When using the electronic piano 9 configured as described above, the one end of the support bar 93 is placed on the guide portion 22 and the music stand 90 is tilted rearward, as shown in FIG. 3. As a result of this action, the one end of the support bar 93 is caught by the catching portion 20*a* near the player, and thereby the music stand 90 is set up on the top plate 9.

To adjust an angle of the music stand 90, the music stand 90 is slightly raised to release the support bar 93 from the catching portion 20*a* currently catching the support bar 93, and to select another catching portion 20*a* to catch the support bar 93.

According to the electronic piano 9 of the present embodiment, the music stand 90 can be set up on the top plate 92 in an angle-adjustable manner relative to the top plate 92 by causing the one end of the support bar 93 to be caught by one of the catching portions 20*a* of the angle adjuster 1.

In the electronic piano 9 of the present embodiment, the thick portions 10 of the angle adjuster 1 have approximately a same thickness as a thickness of the two-fold hinge 91 in a folded state. Accordingly, even if any load is applied to the music stand 90 when the music stand 90 is folded relative to the top plate 92, the thick portions 10 support the music stand 90 and thus can suppress breakage of the hinge 91.

The angle adjuster 1 in the electronic piano 9 of the present embodiment may be manufactured easily by extrusion molding. Also, by employing the angle adjuster 1, the electronic piano 9 of the present embodiment may use the typical two-fold hinge 91 and may use the support bar 93 with a simple bar-like configuration. Therefore, according to the electronic piano 9 of the present embodiment assembled with the angle adjuster 1, an extremely reduced manufacturing cost can be achieved as compared with a case of using a special hinge as mentioned in the background description provided herein.

Further, the electronic piano 9 of the present embodiment allows angle adjustment of the music stand 90 by using the angle adjuster 1, leading to improved functionality of the electronic piano 9.

The depth of the recess of the intermediate portion in the angle adjuster 1 used in the present embodiment is equal to or greater than the thickness of the support bar 93. Also, the support bar 93 is located in the recess of the intermediate portion 20 when the music stand 90 is folded relative to the top plate 92. Accordingly, it is possible to suppress the support bar 93 from being caught between the music stand 90 and the thick portions 10 and thereby being broken.

The angle adjuster 1 of the present embodiment includes the guide portion 22 to guide the one end of the support bar 93 to the catching portions 20*a*. When setting up the music stand 90 in the electronic piano 9 of the present embodiment, it is only necessary to place the one end of the support bar 93 on the guide portion 22 and move the music stand 90. Then, the support bar 93 is guided by the guide portion 22 to be automatically caught by the catching portion 20*a*. According to the electronic piano 9 of the present embodiment, therefore, an operation to set up the music stand 90 by making the music stand 90 to be caught by the catching portion 20 can be extremely easily performed.

Also, in the angle adjuster 1 of the present embodiment, the peripheral area of the upper surface 10*a* of the thick portion 10 is chamfered into a curved surface shape. Accordingly, it is possible to suppress as much as possible the risk that something is caught by the thick portion 10 and thereby the angle adjuster 1 is removed from a stand base.

In the angle adjuster 1 of the present embodiment, when the protruding portion 21 is fitted in the insertion hole 92*a*, the thick portions 10 conceal the insertion hole 92*a*. This enables keeping a good appearance of the electronic piano 9 even when the insertion hole 92*a* is provided in the top plate 92.

Although the electronic piano 9 is described in the present embodiment, it is needless to say that the angle adjuster 1 may be used in an acoustic piano or any other keyboard instrument.

In a case where the depth of the catching portions 20*a* is reduced so as not to form the protruding portion 21 in the angle adjuster 1, the angle adjuster 1 may be attached directly on the top plate 92.

The above description has been provided regarding one embodiment of the present invention. However, the present invention should not be limited to the above-described embodiment, but may be implemented in various forms without departing from the subject matter of the invention set forth in the accompanying claims.

What is claimed is:

1. An angle adjuster for a music stand, comprising:

a pair of thick portions having a thickness equivalent to a thickness of a two-fold hinge in a folded state and arranged to be mutually parallel; and an intermediate portion arranged between the pair of thick portions and recessed relative to upper surfaces of the thick portions perpendicular to a thickness direction thereof, wherein the intermediate portion includes a plurality of catching portions provided mutually parallely along a longitudinal direction of the thick portions, each of the catching portions being configured to catch one end of a support bar to support the music stand.

2. The angle adjuster according to claim 1, wherein a depth of the recessed intermediate portion is equal to or greater than a thickness of the support bar.

3. The angle adjuster according to claim 1, wherein the intermediate portion is configured to define a plurality of continuous wave shapes to form the plurality of catching portions.

4. The angle adjuster according to claim 1, wherein the intermediate portion includes:

a guide portion that is provided at one end side of the intermediate portion along a longitudinal direction of the thick portion and adjacent to a catching portion forming area, where the plurality of catching portions are provided, to guide the one end of the support bar to the catching portion forming area.

5. The angle adjuster according to claim 1, wherein the intermediate portion includes:

a protruding portion that protrudes from a lower end of the thick portions in the thickness direction thereof, the protruding portion having a positioning portion that, when the protruding portion is fitted in an insertion hole provided in a stand base to which the angle adjuster is attached, abuts a wall surface of the insertion hole and defines a position of the protruding portion in the insertion hole.

6. The angle adjuster according to claim 1, wherein a peripheral area of each of the upper surfaces of the thick portions is chamfered into a curved surface shape.

7. A keyboard instrument to which the angle adjuster according to claim 1 is attached, the keyboard instrument comprising:

the music stand;

a stand base relative to which the music stand is folded; and the support bar to support the music stand, wherein the angle adjuster is attached to the stand base, the music stand is configured to be foldable with the hinge relative to the stand base, and the support bar is configured to support the music stand by the one end of the support bar being caught by one of the catching portions, and is attached to one surface of the music stand reverse to a surface thereof facing a player in a foldable manner relative to the music stand.

* * * * *